United States Patent [19]

Rose

[11] Patent Number: 4,523,064

[45] Date of Patent: Jun. 11, 1985

[54] SNAP ACTION SWITCH

[75] Inventor: William H. Rose, Harrisburg, Pa.

[73] Assignee: AMP Incorporated, Harrisburg, Pa.

[21] Appl. No.: 566,259

[22] Filed: Dec. 28, 1983

[51] Int. Cl.[3] ..... H01H 5/18; H01H 9/02

[52] U.S. Cl. ..... 200/67 D; 200/303

[58] Field of Search ..... 200/67 D, 67 DA, 159 A, 200/303, 293, 283

[56] References Cited

U.S. PATENT DOCUMENTS 2,418,831 4/1947 Hamilton ..... 200/67 D 4,207,448 6/1980 Furusawa et al. ..... 200/159 B

*Primary Examiner*—John W. Shepperd

*Attorney, Agent, or Firm*—Adrian J. LaRue; Anton P. Ness

[57] ABSTRACT

A snap action switch comprises stamped and formed stationary electrical contact members and a spring blade contact member. The stationary contact members and the spring blade contact member are secured in respective dielectric housing sections that are secured together forming a housing member with the planar free end of the spring blade contact member in electrical contact with one of the stationary contact members while the other end of the spring blade contact member is secured in its housing section. The other end of the spring blade contact member and the stationary contact members extend exteriorly of the housing member and are in the form of post sections for insertion into holes of a printed circuit board. The spring blade member has an arcuate compression member which, when the spring blade member is unstressed, extends out of the plane of the blade member and tension members on each side of the compression member which are located substantially in the plane of the blade member. An actuating member has engaging sections directly engaging the tension members and an actuating section extending through a hole in one of the housing sections which, when engaged by an operating force, moves the tension members to further stress the spring blade member and move the free end thereof out of contact with the one stationary contact member and into electrical contact with other stationary contact member with a snap action.

10 Claims, 4 Drawing Figures

SNAP ACTION SWITCH

FIELD OF THE INVENTION

This invention relates to switches and more particularly to snap action switches.

BACKGROUND OF THE INVENTION

A snap action switch of the type disclosed in U.S. Pat. No. 2,773,955 is constructed so as to be used to switch high voltage at high current. The spring blade has silver contacts welded thereto at a free end which electrically connect with stationary silver contacts. The other end of the spring blade is mounted between support members, one support member engages tension members of the spring blade while the other support member engages a compression member of the spring blade. An actuating member engages one of the support members to move the portion thereof engaging the tension members relative to the other of the support members to further stress the spring blade and move the free end thereof out of contact with one of the stationary contacts and with a snap action engages the other of the stationary contacts. These types of switches have been used on printed circuit boards of electronic equipment because of their high cycle of operating reliability and because no low cost, high cycle, and reliable snap action switch for use on printed circuit boards using low voltage and low current is available. The present invention provides such snap action switch.

SUMMARY OF THE INVENTION

According to the present invention, a snap action switch comprises stamped and formed stationary electrical contact members and a spring blade contact member. The stationary contact members and the spring blade contact member are secured in respective dielectric housing sections that are secured together forming a housing member with the planar free end of the spring blade contact member in electrical contact with one of the stationary contact members while the other end of the spring blade contact member is secured in its housing section. The other end of the spring blade contact member and the stationary contact members extend exteriorly of the housing member and are in the form of post sections for insertion into holes of a printed circuit board. The spring blade member has an arcuate compression member which, when the spring blade member is unstressed, extends out of the plane of the blade member and tension members on each side of the compression member which are located substantially in the plane of the blade member. An actuating member has engaging sections directly engaging the tension members and an actuating section extending through a hole in one of the housing sections which, when engaged by an operating force, moves the tension members to further stress the spring blade member and move the free end thereof out of contact with the one stationary contact member and into electrical contact with the other stationary contact member with a snap action.

DETAILED DESCRIPTION OF THE INVENTION

Figure 1:
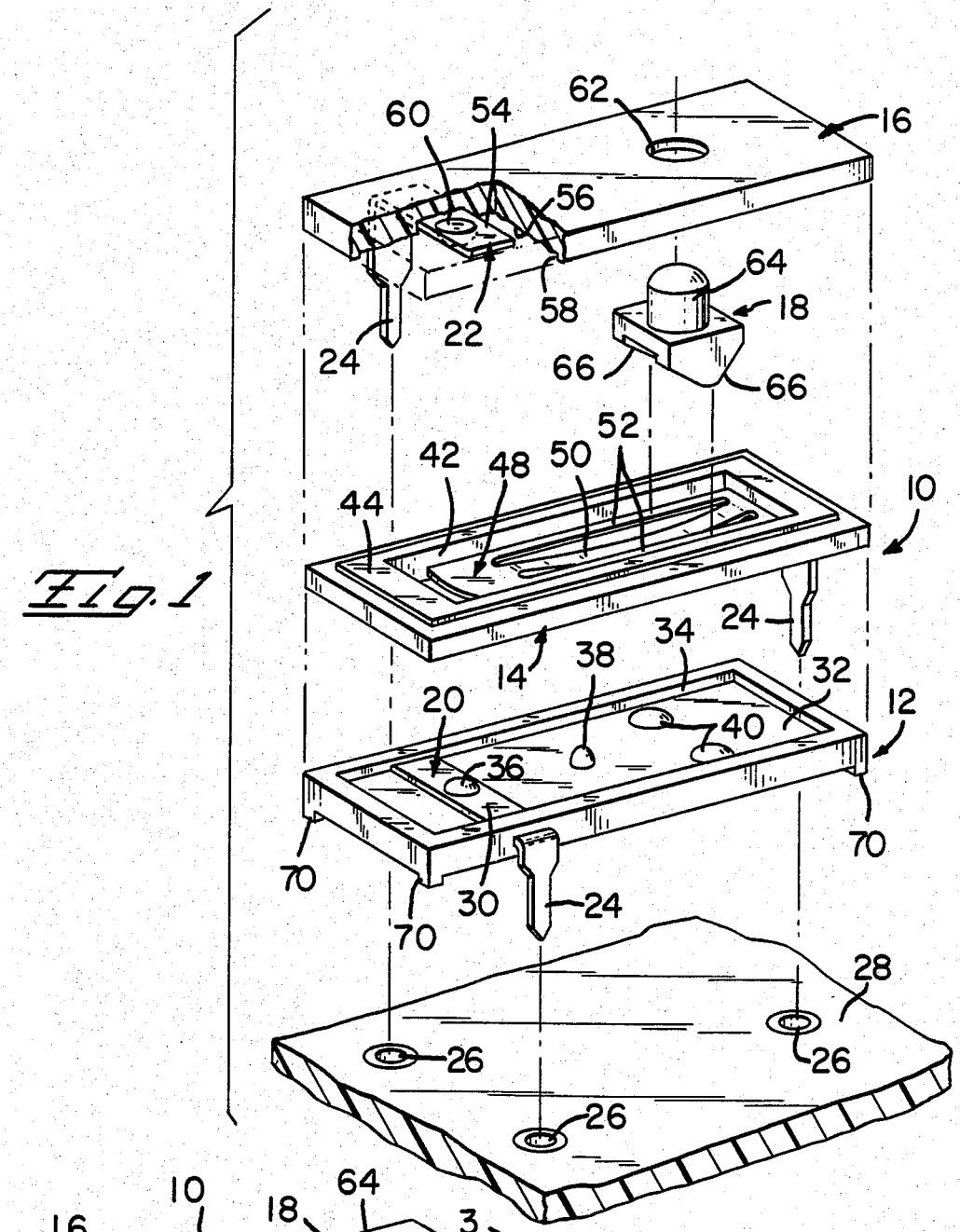
FIG. 1 is an exploded and perspective view of parts of a snap action switch and a part section of a printed circuit board.

A snap action switch 10 as shown in FIGS. 1–4 of the drawings comprises a first housing section 12, a second housing section 14, a third housing section 16 and an actuating member 18. Housing sections 12, 14 and 16 and actuating member 18 are molded from a suitable plastic material having the desirable characteristics. Stationary contact members 20 and 22 are located in housing sections 12 and 16 respectively and they are preferably molded in position therein. Contact members 20 and 22 are stamped and formed and they have post section 24 extending outwardly from housing sections 12 and 16 for insertion into respective holes 26 of printed circuit board 28. Contact section 30 of stationary contact member 20 extends along a bottom surface 32 of a cavity 34 in housing section 12. An outwardly-directed contact 36 is located on contact section 30. Outwardly-directed members 38 and 40 are located on bottom surface 32 of cavity 34.

Figure 3:
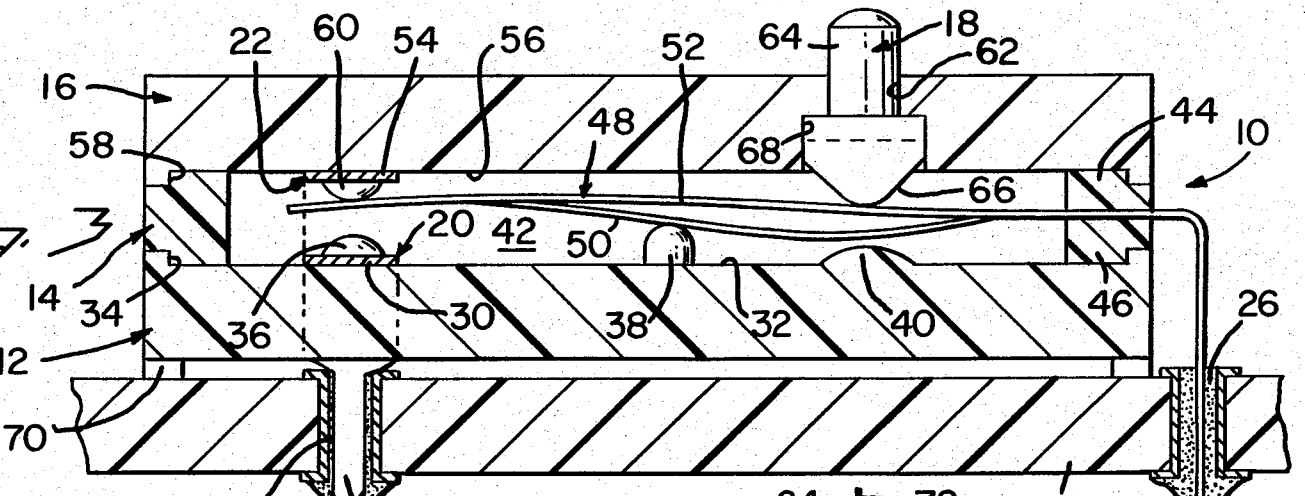
FIG. 3 is a cross-sectional view of FIG. 2 showing the spring blade contact member in a non-operative position.

Housing section 14 has a rectangular opening 42 extending therethrough with rectangular projections 44 and 46 framing opening 42 on each side of housing section 14. A spring blade contact member 48 is molded in position in housing section 14 and is stamped and formed from a suitable conductive metal having the desirable spring characteristics such as, for example, beryllium copper or phosphor bronze. Spring contact member 48 is slotted intermediate its length to provide a central compression member 50 and two outer tension members 52. The free end of spring blade member 48 is planar and defines a movable contact for electrical contact with stationary contact members 20 and 22. A post section 24 of spring blade member 48 extends outwardly from housing section 14 for insertion into a respective hole 26 in printed circuit board 28. Compression member 50 is arched out of the general plane of the blade member 48 so as to impart thereto a permanent bend, the radius of the arch being greater at the end of blade member 48 that is secured in housing section 14 when the switch is in its assembled form with the free end in engagement with one of the stationary contact members 20 and 22 as shown in FIG. 3. Tension members 52 are located substantially in the same plane of the blade, and they have a slight arcuate bend in a direction opposite to that of compression member 50 to effectively shorten their length to accommodate the arching out of compression member 50 and further to provide them with greater spring characteristics.

Figure 2:
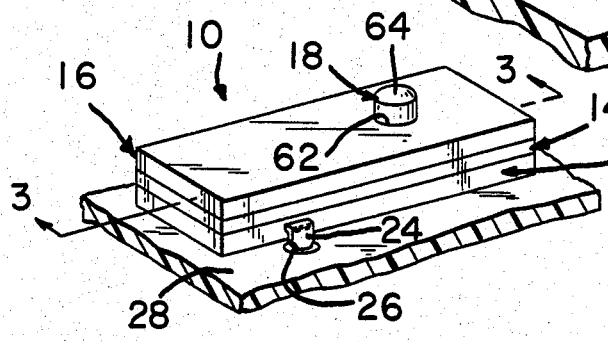
FIG. 2 is a perspective view of the switch of FIG. 1 in an assembled form on the printed circuit board.

Contact section 54 of stationary contact member 22 extends along a bottom surface 56 of a cavity 58 located in third housing section 16. Outwardly-directed contact 60 is located on contact section 54. A hole 62 extends through housing section 16 through which actuating section 64 of actuating member 18 extends and arcuate-shaped engaging members 66 directly engage tension members 52 of spring blade contact member 48 when housing sections, 12, 14 and 16 are assembled together as a housing member thereby forming snap action switch 10 in its completed condition as shown in FIG. 2. It is to be noted that engaging members 66 engage tension members 52 between the center of blade member 48 and where blade member 48 is secured in housing section 14.

In assembly, housing sections 12 and 14 with stationary contact member 20 molded in position in housing section 12 and spring blade contact member 48 molded in position in housing section 14 are assembled together with rectangular projection 46 being disposed within cavity 34 of housing section 12. Engaging members 66 of actuating member 18 are positioned on tension members 52 and housing section 16 with stationary contact member 22 molded in position therein is assembled onto housing section 14 with actuating section 64 of actuating member 18 extending through hole 62 of housing section 16 and rectangular projection 44 of housing section 14 being disposed within cavity 58 of housing section 16. The housing sections can be adhered together by a suitable conventional adhesive material or they can be ultrasonically welded together in accordance with conventional ultrasonic welding practices. A cavity 68 is located in bottom surface 56 of housing section 16 and is in communication with hole 62 to accommodate and guide engaging members 66 of actuating member 18 during the operation of actuating member 18. Projections 70 are located on the bottom surface of housing section 12 for engagement with printed circuit board 28 to space switch 10 therefrom when mounted in position thereon.

Figure 4:
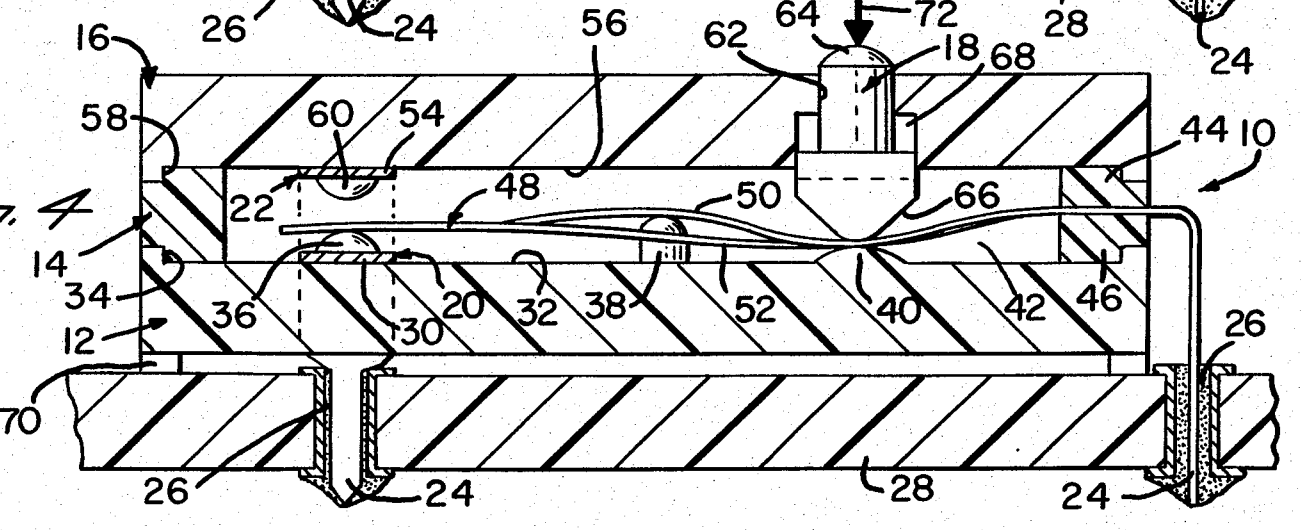
FIG. 4 is a view similar to FIG. 3 showing the spring blade contact member in an operative position.

FIG. 3 shows switch 10 in a normal nonoperative position whereby the free end of spring blade contact member 48 is in electrical engagement with outwardly-directed contact 60 of stationary contact member 22, central compression member 50 is in engagement with outwardly-directed member 38, and tension members 52, which have a slight arcuate configuration in the opposite direction of central compression member 50 are directly engaged by engaging members 66 of actuating member 18 thereby maintaining actuating section 64 in a normally inoperative position and engaging members 66 within cavity 68. The spring action of blade member 48 in its nonoperating position preloads blade member 48 so that the free contact end is spring-biased against outwardly-directed contact 60. When an actuating force 72 is applied to actuating section 64 of actuating member 18 as shown in FIG. 4, engaging members 66 move tension members 52 into engagement with outwardly-directed members 40 and when tension members 52 move slightly beyond the operating center of spring contact member 48, the spring forces of compression member 50 and tension members 52 operate to cause spring contact member 48 to operate with a snap action thereby moving the free end of spring blade contact member 48 from outwardly-directed contact 60 of stationary contact member 22 to outwardly-directed contact 36 of stationary contact member 20 as shown in FIG. 4. As can be discerned from FIGS. 3 and 4, compression member 50 remains in engagement with outwardly-directed member 38 at all times and tension members 52 engage outwardly-directed members 40 to prevent overstressing thereof. Also, outwardly-directed member 38 is higher than outwardly-directed members 40. When spring contact member 48 is in an operative position as shown in FIG. 4, compression member 50 is slightly above tension members 52 and is accommodated in the space between engaging members 66, spring contact member 48 is then in a condition so that when operating force 72 is released, and spring blade member 48 will snap back to its original position as illustrated in FIG. 3. The operating force required is relatively light for a switch of such construction, the transverse rate of the free end of the spring blade member is high, and negligible contact bounce is encountered during operation of switch 10. Switch 10 is a single-pole double-throw switch, is of simple construction, has a minimum of parts, is of low cost construction, is printed circuit board-mountable, has a high cycle life of operation, and is highly reliable. Outwardly-directed contacts 36 and 60 of stationary contact members 20 and 22 and the free end of spring blade contact member 48 are preferably selectively plated with gold to enhance the electrical contact therebetween.

If desired, silver contacts can be secured onto stationary contact members 20 and 22 in place of outwardly-directed contacts 36 and 60, and a silver contact can also be secured onto the free end of spring blade contact member 48 for higher voltage and current operation but still would provide a low-cost switch compared to those currently available.

I claim:

1. A snap action switch, comprising:

a dielectric housing including a middle section and first and second outer sections, said middle section having a rectangular opening and said outer sections having a cavity therealong;

a spring blade contact member having one end secured in said middle section, said spring blade contact member including a central compression member arched out of the plane of the spring blade contact member, tension members on each side of the central compression member and a free end defining a movable contact member, said central compression member, said tension members and said movable contact member being disposed in said rectangular opening and freely movable therein;

a first stationary contact member having one end secured in said first outer section and a first stationary contact section disposed along a bottom surface of the cavity thereof in alignment with the movable contact member;

a second stationary contact member having one end secured in said second outer section and a second stationary contact section disposed along a bottom surface of the cavity thereof in alignment with the movable contact member;

means provided by said middle and outer sections matably mounting them together forming said housing with said movable contact member in normal electrical engagement with one of the first and second stationary contact sections; and an actuating member movably mounted in said second outer section and including actuating sections directly engaging the tension members to move the tension members relative to the compression member when an actuating force is applied to the actuating member to further stress the spring blade contact member and move the movable contact member out of electrical engagement with the one stationary contact section with a snap action.

2. A snap action switch as claimed in claim 1, wherein the outer section containing the stationary contact section with which the movable contact member is moved into engagement when the spring blade contact member is operated includes an outwardly-directed member against which the compression member engages.

3. A snap action switch as claimed in claim 2, wherein other outwardly-directed members are located on the outer section against which the tension members engage when they are moved thereagainst by the actuating sections.

4. A snap action switch as set forth in claim 1, wherein said second outer section has a hole therethrough and said actuating member has an actuating section extending through said hole so that the actuating force can be applied thereto.

5. A snap action switch as set forth in claim 4, wherein said actuating member is positioned between the center of said spring blade contact member and the end that is secured in its housing section.

6. A snap action switch as set forth in claim 4, wherein said second outer section has a recess in communication with said hole in which said actuating sections of said actuating member is disposed.

7. A snap action switch as set forth in claim 1, wherein said actuating member has a space between said actuating sections to receive the compression member when the spring blade member has been moved from its nonoperative to its operative position.

8. A snap action switch as claimed in claim 1, wherein said mounting means comprise projections on said middle section that are disposed in the cavities of the outer sections.

9. A snap action switch as set forth in claim 1, wherein the outer section containing the stationary contact section with which the movable contact member of the spring blade contact member is moved into engagement when the spring blade member is operated includes an outwardly-directed member against which the compression member engages and other outwardly-directed members which are engaged by the tension members when they are moved thereagainst by the directly-engaging actuating sections.

10. A snap action switch as set forth in claim 9, wherein said other outwardly-directed members are lower than the outwardly-directed member engaged by the compression member.

* * * * *